United States Patent [19]

Zazimko et al.

[11] 4,079,616

[45] Mar. 21, 1978

[54] DRAW BENCH FOR PRODUCING CYLINDRICAL TUBULAR ITEMS BY DRAWING

[76] Inventors: Viktor Afanasievich Zazimko, ulitsa Parizhskoi Kommuny, 20a; Gennady Alexandrovich Savin, ulitsa Vyborgskaya, 33a, kv. 15; Mikhail Vladimirovich Babasov, ulitsa Tsentralnaya, 10, kv. 14; Igor Yakovlevich Volin, ploschad Leninskogo Komsomola, 1, kv. 18; Vitaly Fedorovich Shevchenko, prospekt K.Marxa, 37; Iraida Ivanovna Reidemeister, ulitsa Universitetskaya, 10, kv. 55, all of Dnepropetrovsk; Nikolai Konstantinovich Erokhov, ulitsa Bogomoltsa, 10; Ivan Markovich Evtushenko, ulitsa Shevchenko, 243, kv. 45, both of Nikopol, all of U.S.S.R.

[21] Appl. No.: 668,590

[22] Filed: Mar. 19, 1976

[51] Int. Cl.[2] ..... B21C 1/30

[52] U.S. Cl. ..... 72/278; 72/285; 72/290

[58] Field of Search ..... 72/283, 285, 278, 64, 72/290, 246, 371

[56] References Cited

U.S. PATENT DOCUMENTS

| | | | |
|---|---|---|---|
| 1,525,730 | 2/1925 | Gates | 72/64 |
| 1,967,487 | 7/1934 | Waisner | 72/283 |
| 2,250,610 | 7/1941 | Simons | 72/64 |
| 2,864,271 | 12/1958 | Kendall | 72/421 |
| 3,077,131 | 2/1963 | McShane | 72/246 |
| 3,466,916 | 9/1969 | Marcovitch | 72/299 |
| 3,520,165 | 7/1970 | Dodson | 72/64 |
| 3,955,390 | 5/1976 | Geary | 72/64 |

FOREIGN PATENT DOCUMENTS

| | | | |
|---|---|---|---|
| 182,939 | 8/1955 | Germany | 72/194 |

*Primary Examiner*—Michael J. Keenan

*Attorney, Agent, or Firm*—Lackenbach, Lilling & Siegel

[57] ABSTRACT

A method of producing cylindrical tubular items by drawing and a draw bench relate to methods and devices for plastic working of materials in a cold state. In the course of manufacturing cylindrical tubular items by drawing, said items are subjected to deformation on being drawn through a die and are imparted simultaneously a torsional moment, said torsional moment being imparted to that portion of each item which emerges from the die, while the item portion found in front of the die is restricted from torsion. The draw bench adapted for realizing the method of the invention comprises a device for drawing items through the die, said device being made as a driven carriage, a means for imparting to the item a torsional moment, said means being arranged on said carriage, and a means for restricting the item from torsion arranged at the die entry. Such method and draw bench allow obtaining drawn items featuring sufficient rectilinearity to be transferred to subsequent technological operations without intermediate and final straightening thereof.

4 Claims, 7 Drawing Figures

DRAW BENCH FOR PRODUCING CYLINDRICAL TUBULAR ITEMS BY DRAWING

The present invention relates to methods and devices for plastic working of metals in a cold state and more particularly to methods of producing cylindrical tubular items by drawing and to draw benches for effecting said methods.

At present tubular metal cylinder-shaped items produced by drawing usually depart essentially from rectilinearity. This stems from the factors inherent in the drawing method so far adapted and discussed below.

The axis of the working die passage is not sufficiently in alignment with the direction of the drawing force which results in the item curving in the same direction in which the drawing force deviates from the die axis.

In manufacturing dies insignificant deviations from accurate geometry are unavoidable which causes nonuniform distribution of internal stresses over the circumference of the item that is being drawn through the die and, consequently, to its distortion.

Nonuniform deformation over the circumference and along the length of the item are also the result of unavoidable segregation in the properties of the item material and inaccurate geometry (variations in wall thickness) of the items subjected to drawing. As a result of said nonuniform deformations the item is curved.

Under the effect of the above-outlined and other factors the items produced by drawing depart from rectilinearity, which presents serious problems and on a number of cases requires intermediate straightening which alone enables the subsequent technological operations. The need for such intermediate straightening cuts down the output of draw shops, required additional straightening facilities and floor areas to mount them thereon and, finally, adds to the production cost of finished products.

Nowadays various devices are resorted to take care of said distortion of items during the drawing operation.

Thus, known in the art is a device for drawing tubes, in which a die having a spherical external surface is inserted in a spherical seat in a die holder. Due to congruent spherical mating surfaces of the die and its holder, the die is self-oriented in the holder during drawing, this precluding the curving of the items resulting from the deviation of the axis of the die working passage from the direction of the drawing force.

However, the items produced by drawing nevertheless depart considerably from rectilinearity, insofar as the spherical die holder obviates only one of the causes of such distortion, the need for intermediate straightening being therefore not eliminated. Moreover, machining and subsequent fitting-in of the spherical surfaces of both the die and its holder are complicated technological operations which are inexpedient economically, insofar as the dies of the spherical surfaces do not eliminate the curvature but only diminish it slightly.

Also known in the prior-art is a device, in which an item is straightened during the drawing operation by applying to it alternating bending forces. In the above device a straightening gear is arranged on the exit side of the die, said gear having an annular guide in high-strength metal through which the item passes. The guide is set up in a driven bushing eccentric to the drawing axis. When the driven bushing is rotating, the guide oscillates about the drawing axis, the item being therefore subjected to an alternating bending force, and subsequent straightening of said item.

However, said device is not capable of providing adequate straightening due to the lack of a support on the exit side of said device. Moreover, it is characterized by a sophisticated design, since it must comprise an additional drive to rotate the guide and requires a longer received end, this resulting in higher metal consumption.

Known as well is a method of producing cylindrical tubular items by drawing, in which the items are subjected to deformation on being drawn through a die and imparted simultaneously a torsional moment, said moment being applied to the end of that portion of the item which is found in front of the die. This method could have provided not only better deformation conditions and lower drawing forces but it could have decreased the distortion of the items being drawn. However, it has not found industrial application due to high intricacy of the devices required for its realization.

The main object of the present invention is to provide a method of producing cylindrical tubular items by drawing and a draw bench for effecting said method which will ensure the production of items, such as, tubes, featuring adequate rectilinearity so that they can be transferred to subsequent technological operations without intermediate and ultimate straightening, this being achieved by improving the existing method of drawing and introducing simple modifications into the design of a draw bench.

With this and other objects in view, in a method of producing cylindrical tubular items by drawing, in which the item is subjected to deformation in the course of drawing through a die and is imparted simultaneously a torsional moment, according to the invention, said torsional moment is imparted to that portion of the item which emerges the die, while the item portion found in front of the area of deformation is restricted from torsion.

By combining deformation by reduction and deformation by torsion in the reduction and non-contact zones of the die, it is possible to ensure a uniform distribution of the total plastic deformation over the cross-section and along the length of the tube, as a result of which the tube is not required to be treated in a straightening apparatus prior to any subsequent manufacturing stages.

It is expedient that an item portion arranged directly in front of the die entry be restricted from torsion. This will make it possible to have the desirable angle of torsion of the item to ensure its rectilinearity.

The proposed method is realized by means of a draw bench, comprising a bed which mounts a case with a die, a device for drawing the item through the die, said device being made as a driven carriage mounted in the bed guides on the exit side of the die and carrying a chuck having workpiece holding jaws, and a device for imparting the item a torsional moment. According to the invention, in said draw bench the device for imparting a torsional moment to the item is located on the driven carriage and is linked mechanically with its jaws mounted in the carriage rotatable coaxially about the die, a device for restricting the item from torsion being disposed in generally close proximity to the die entry. This ensures a rectilinear nature of the item by using a draw bench of a simple and compact construction.

The draw bench, according to the invention, is characterized by a device for imparting a torsional moment to the item which is made as a reducer whose output shaft carries the jaws mounted with facility for longitudinal movement, while its input shaft is indirectly linked with a carriage drive.

It is sound practice that the output shaft of the reducer be linked mechanically with the carriage drive with the aid of a sprocket wheel mounted on the input shaft and interacting with a roller chain running along the bed guide, with the chain ends being fixed in the bed. With the above embodiment an angle of rotation of the chuck is not dependent on the carriage travel rate and is determined only by the length of its path. Therefore an angle of torsion per unit length of an item being drawn will have a constant value along the entire length of the item.

A feature of the invention consists also in that the device for restricting the item from torsion comprises a casing accommodating the case with the die, said case being mounted movably along the die axis, spring-biased rods articulated with the case, and a pair of grooved rollers set up directly in front of the item entering in the die, the rollers spaced from each other allow mounting an item therebetween and are adapted to hold it in place when a torsional moment has been imparted.

The grooved rollers are advisable to be mounted in the casing with the help of two pairs of arms, the arms of each pair being articulated with their ends with each other and with the spring-biased rod, while their free ends are articulated accordingly with the roller axis and with the casing.

Said embodiment of the device for restricting the item from torsion, though seemingly complicated, it is sufficiently easy and the most reliable one.

Thus, the proposed method of drawing and the draw bench enable the production of items featuring sufficient rectilinearity upon drawing to be transferred to subsequent technological operations without intermediate and final straightening, a feature which adds considerably to labor productivity and diminishes the production cost of finished products.

The nature of the invention will be clear from the following detailed description of particular embodiments of the proposed method of producing cylindrical tubular items by drawing and of the draw bench to be had in conjunction with the accompanying drawings, in which.

Figure 1:
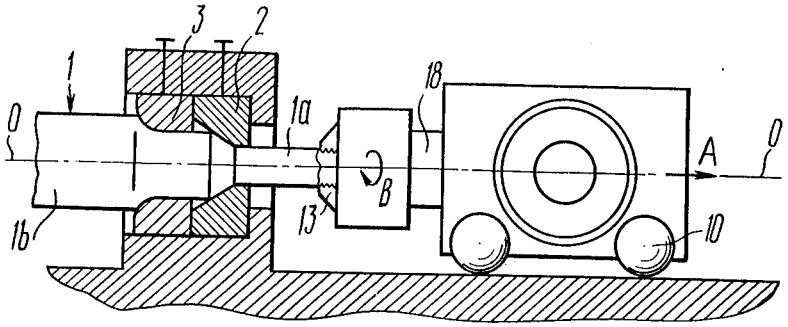
FIG. 1 is a schematic drawing illustrating the proposed method, according to the invention.
Figure 3:
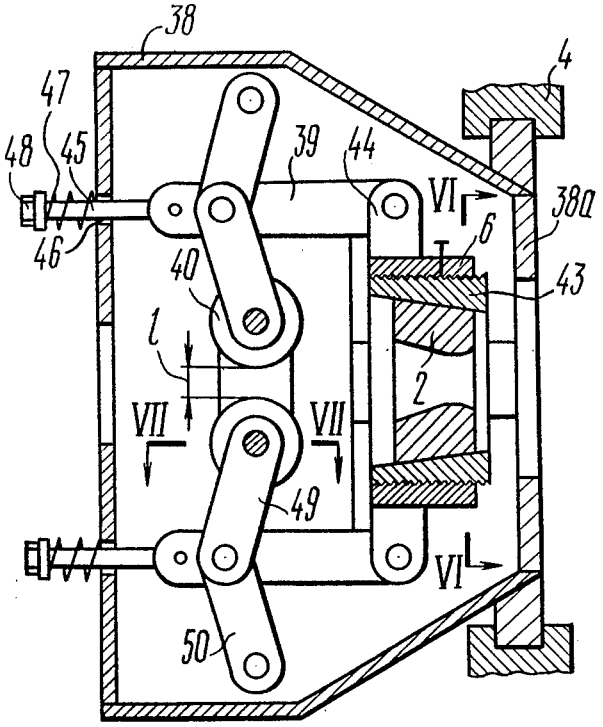
FIG. 3 is a longitudinal fragmentary section through a device for restricting an item from torsion.
Figure 6:
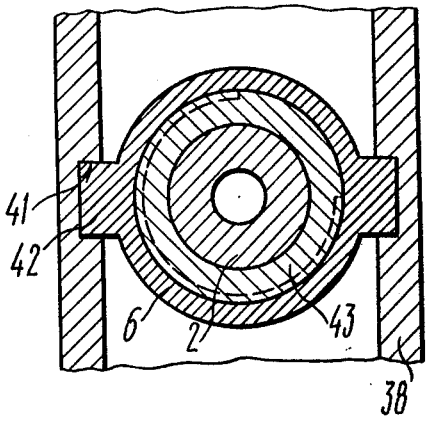
Figure 7:
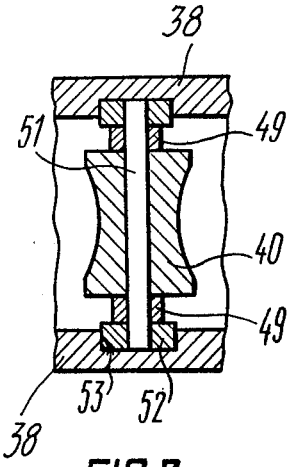
Figure 4:
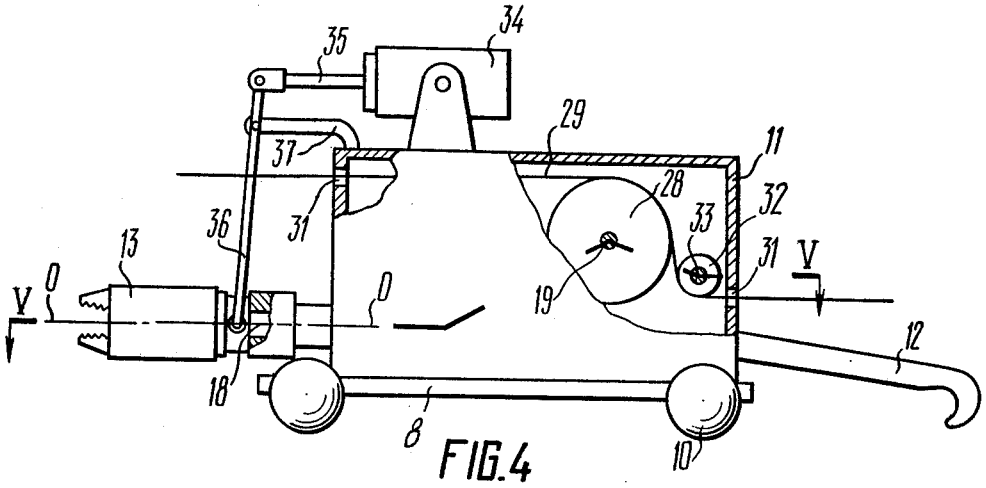
FIG. 4 is a side elevational view of a gear or driven carriage for drawing an item, with said driven carriage partially shown in section.
Figure 5:
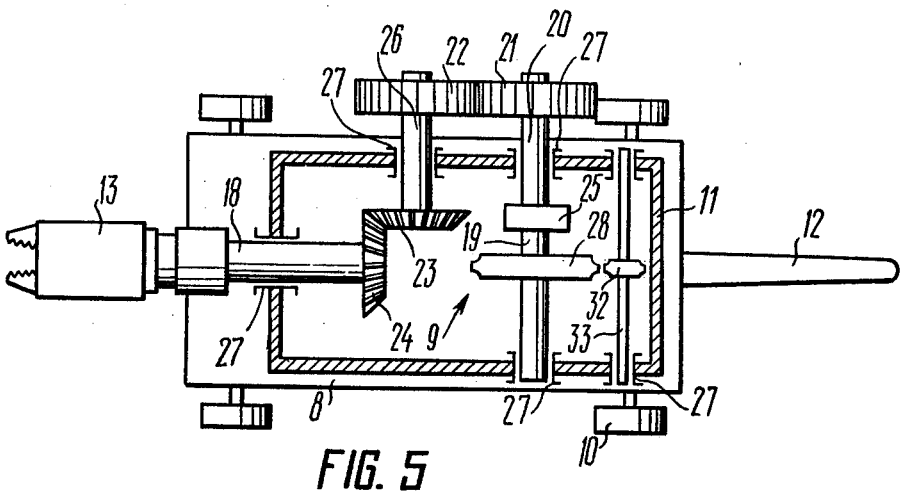

FIG. 5 section V — V of FIG. 4;

FIG. 6 — section VI — VI of FIG. 3;

FIG. 7 — section VII — VII of FIG. 3;

A method of producing cylindrical tubular items by drawing consists in that an item 1 (FIG. 1) is subjected to deformation on being drawn through a die 2 in the direction indicated by arrow A. During drawing the item 1 is imparted a torsional moment acting in the direction indicated by arrow B, said torsional moment being imparted to that portion 1*a* of the item 1 which emerges from the die 2, while the portion 1*b* which is found to be in front of the die 2 is restricted from torsion, e.g., by an additional die 3, that is set up directly in front of the item entering the die 2, and has an oval opening which contributes to the longitudinal transfer of the item but rules out its turning.

Figure 2:
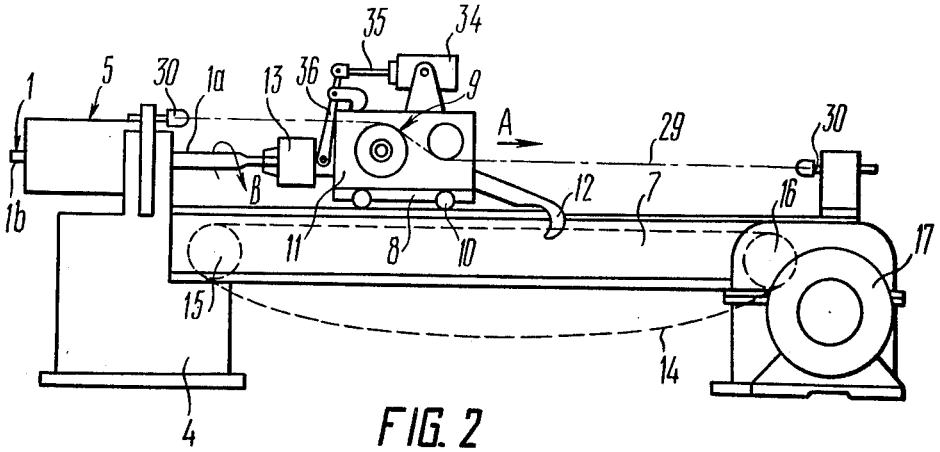
FIG. 2 is a further schematic-like drawing in side elevation showing a draw bench, according to the invention.

For carrying said method into effect a draw bench is proposed whose bed 4 (FIG. 2) mounts a device 5 for restriction the item from torsion having a case 6, (FIG. 3) with the die 2, guides 7 (FIG. 2) a device for drawing the item through the die 2, said device being made as a driven carriage 8, a device 9 for imparting the item a torsional moment.

The carriage 8 (FIG. 2) is arranged on the exit side of the die 2 and comprises a body 11 (FIG. 4) mounted on rollers 10 travelling on the guide 7 (FIG. 2) of the bed 4, said body 11 carrying a hook 12 and a chuck 13 for gripping the item (the design of the jaws is not discussed here, since it is commonly known). The carriage 8 is driven by an endless chain 14 (shown with a dotted line in FIG. 2) encompassing a driven sprocket wheel 15 and a driving sprocket wheel 16 mounted on the bed 4. The driving sprocket wheel 16 is coupled by any known means, such as a gear, not shown in FIG. 2, with an electric motor 17. The hook 12 of the carriage is engaged with the endless chain 14 when drawing.

The device 9 (FIG. 5) for imparting a torsional moment to the item is placed on the carriage 8 and is linked mechanically with its chuck 13. Said device 9 is made as a geared reducer arranged in the body 11 and comprising an output shaft 18, an input shaft 19 and intermediate shaft 20, spur pinions 21 and 22 and bevel pinions 23 and 24. The input shaft 19 is linked mechanically with a carriage drive and through an overrunning clutch 25 with the intermediate shaft 20 which carries the spur pinion 21 on its end. The pinion 21 is in mesh with the pinion 22 mounted on a shaft 26. Fixed on the opposite end of the shaft 26 is the bevel pinion 23 in mesh with the bevel pinion 24 secured on the output shaft 18. The carriage chuck 13 is disposed on the output shaft 18 with means for longitudinal transfer.

The shafts 33, 19 as well as the intermediate shaft 20 and shafts 26 and 18 are mounted in bearings 27 of the body 11, shown in FIG. 5 conventionally so as not to impair the gearing relationship. Longitudinal transfer of the chuck 13 is provided by coupling it with the shaft 18 by resorting to any known means, e.g., such as with a key, through which the jaws can rotate together with said shaft. The axis of the chuck 13 (FIG. 1) is aligned axially with the axis of the die 2, with the resulting effect of the geometric axis of rotation O—O of the shaft 18 coinciding thereby with the axis of the die 2.

The input shaft 19 (FIG. 5) is indirectly linked with the carriage drive 8 by means of a sprocket wheel 28, fixed on the shaft 19, and a roller chain 29, shown in FIG. 4 conventionally with a solid line, said chain 29 running along the guide 7 (FIG. 2) of the bed 4. The ends of the chain 29 are secured on bed uprights by means of screws 30. The roller chain 29 passes through ports 31 (FIG. 4) provided in the body 11 and interacts with the sprocket wheel 29. To increase an angle of contact of the chain 29 and sprocket wheel 28 the body 11 accommodates an additional sprocket wheel 32 mounted on a shaft 33 (FIG. 5) that is secured in the bearings 27 of the body 11.

Longitudinal transfer of the chuck 13 is effected with the help of an air cylinder 34 (FIG. 4) fixed on the body 11. An air cylinder rod 35 is articulated with a pull rod 36 which in turn is articulated with the chuck 13 and a bracket 37 secured on the body 11.

The device 5 (FIG. 3) for restricting the item from torsion comprises a casing 38 fixed on the bed 4, said casing accommodating the case 6 with the die 2, a pair of spring-biased rods 39 and a pair of grooved rollers 40 spaced at a distance *l* from each other, as best shown in FIG. 3, to let the item pass therebetween and adapted to restrict the portion 1*b* of the item from torsion.

A wall 38*a* of the casing 38 is provided with slots 41 (FIG. 6) receiving projections 42 of the case 6, by which virtue the case 6 can move together with the die 2 along its axis. The transfer of the case 6 with the die 2 is restricted by the wall 38*a* of the casing 38. The case 6 (FIG. 3) accommodates a screw-down seat 43 of the die 2.

The case 6 has two diametrically opposite forks 44 the rods 39 being articulated with said forks 44. Connected to the ends of the rods 39 are bars 45 extending out of the casing 38 through its openings 46. The bars 45 mount springs 47 which are held in place by nuts 48 and adapted to bias the rods and to return the rollers 40 into their initial position.

To restrict the portion 1*b* of the item from torsion toggle-like mounted rollers 40 are set up in the casing 38 with the aid of two pairs of arms, each pair comprising two arms 49 and 50 accordingly, articulated with their ends with each other and with the rod 39. The free end of the arm 49 is articulated with the roller 40 and that of the arm 50 with the casing 38. To hold the rollers 40 reliably in place the arms 49 can be made as a fork encompassing the roller 40 from both sides, as shown in FIG. 7. Each grooved roller 40 has a configuration shown in FIG. 7 and is fixed on a spindle 51 whose ends are arranged in bushings 52 inserted into the slots 53 of the casing 38. The arms 49 are located intermediate of the bushings 52 and roller 40.

The proposed draw bench operates in the following manner.

To prepare the bench for operation the case 6 is set up in the device 5 by rotating the seat 43 (FIG. 3), said case 6 being spaced at a distance from the wall 38*a* of the casing 38 so that the grooved rollers 40 will reliably hold the item portion 1*b* (FIG. 2) against torsion. Following that the electric motor 17 is cut in and sets in motion the chain 14, after which an item is fed through the die 2 (FIG. 1) so that its received end protrudes from the die 2. Next the carriage 8 is advanced to the received end of the item and the air cylinder 34 (FIG. 2) is cut in.

When the air cylinder is cut in, the rod 35 is pulled in, turning the pull rod 36 which carries the chuck 13 ensuring a rigid connection with the received end of the item. After that the hook 12 is engaged with the chain 14, as a result the carriage 8 will travel over the guides 7 of the bed 4. At the same time as the carriage 8 commences to move the driven sprocket wheel 28 (FIG. 4) rolls along the roller chain 29 bringing into rotation the shaft 19 and through the overrunning clutch 25 (FIG. 5) the shaft 20 pinion 21 and pinion 22 in mesh therewith. The latter (pinion 22) brings into rotation through the shaft 26 the bevel pinions 23 and 24. As the pinion 24 is fixed on the shaft 18, which carries the chuck 13, the latter on being rotated transmits the torsional moment to the portion 1*a* of the item 1 (FIG. 2), said portion 1*a* projecting from the die 2. Simultaneously it draws the item through the die 2.

At the beginning when the item 1 is being drawn through the die 2, the case 6 (FIG. 3) will move in the direction of the motion of the item 1 unitl it strikes against the wall 38*a* of the casing 38. During said travel of the case 6, the forks 44 will transfer the rods 39 and bars 45 compressing the springs 47, the arms 49 and 50 turning thereby with respect to the rods 39. Since the spindles 51 of the rollers 40 are mounted in the bushings 52 fitted into the slots 53, when the arms 50 and 49 rotate with respect to the grooved rollers 40, the latter will move towards each other, gripping the portion 1*b* of the item which is formed of the die 2 and holding it thereby against torsion but enabling its passage through the die 2.

Thus, the portion 1*b* of the item 1 is restricted from torsion by the grooved rollers 40, while the portion 1*a* of said item is subjected to turning owing to rotation of the chuck 13, the torsion pitch of the item being constant along the entire drawing path and is not dependent on the drawing rate, since the angle of rotation of the chuck jaws is in a linear relationship (through the sprocket wheel 28 (FIG. 4) and chain 29 with the path of the carriage 8.

After the item 1 has emerged from the die 2, the compressed springs 47 drive the bars 45 and rods 39 together with the case 6 in the direction opposite to the drawing direction, the arms 49 and 50 turning with respect to the rods 39 and drawing the grooved rollers apart, providing thereby free space for the next item to be fed therein.

The air cylinder 34 is engaged by the rod 35 coming out and when the pull rod 36 is rotated, the chuck 13 moves, and the item 8 is released in a known way.

During an idle stroke of the carriage 8 (FIG. 5) the chuck 13 does not rotate owing to the overrunning clutch 25 which provides favorable conditions for gripping the next item.

What we claim is:

1. A drawbench, comprising: a bed; bed guides; a case with a die mounted on said bed to effect the deformation of a tubular item which is being drawn through the die; a device for drawing the item through the die consisting of a carriage set up in said bed guides on the exit side of the die, a drive for said carriage, and a chuck with jaws for gripping the item mounted on said carriage, said chuck being axially aligned with said die; a device for imparting to the item a torsional moment mounted in the carriage, and consisting of a geared reducer having an output shaft carrying said chuck with means associated therewith for longitudinal transfer of said chuck and having an input shaft indirectly mechanically linked by means of a chain and sprocket with the drive of the carriage; and a device for restricting the item from torsional moment positioned on said bed in generally close proximity to the die entry and having a pair of toggle-like mounted rollers having grooves to hold said item, whereby a satisfactory rectilinearity of the item is obtained.

2. A draw bench according to claim 1, in which the geared reducer output shaft is indirectly linked with the drive of the carriage with the aid of a sprocket wheel fixed on the input shaft and interacting with a roller chain running along the bed guide and having fixed ends.

3. A drawbench, comprising: a bed; bed guides; a case with a die mounted on said bed to effect the deformation of a tubular item which is being drawn through the die; a device for drawing the item through the die consisting of a carriage set up in said bed guides on the exit side of the die, a drive for said carriage, and a chuck with jaws for gripping the item mounted on said carriage, said chuck being axially aligned with said die; a device for imparting to the item a torsional moment mounted in the carriage and being linked mechanically by means of a chain and sprocket with said chuck; and a device for restricting the item from torsional moment positioned on said bed in generally close proximity to the die entry, a pair of toggle-like mounted rollers having grooves to hold said item, whereby a satisfactory rectilinearity of the item is obtained, and consisting of a casing accommodating the case with a die mounted so as to be movable along the axis of the die, spring-biased rods articulated with the case, and said pair of rollers arranged at the die entry, spaced from each other to provide a passage therebetween for the item, and holding the item to prevent any torsional moment.

4. A draw bench according to claim 3, in which the grooved rollers are mounted in the casing by means of two pairs of arms, the arms of each pair being articulated at a common end with respect to each other and with the spring-biased rods, while their other ends are articulated with the rollers with respect to one pair of arms and with the casing with respect to the other pair of arms.

* * * * *